US005258253A

United States Patent [19]

Fukumoto et al.

[11] Patent Number: 5,258,253

[45] Date of Patent: Nov. 2, 1993

[54] MAGNETIC CARRIER FOR ELECTRONIC REPRODUCTION COATED WITH A NITROGEN CONTAINING SILICONE RESIN

[75] Inventors: Takatomo Fukumoto, Osaka; Takashi Teshima, Ibaragi; Kazuhiko Yamamura, Higashi-osaka; Kyouya Taguchi, Nishinomiya; Hiroyuki Hazama, Itami; Takeshi Higuchi, Yamato-kouriyama; Koji Honda, Higashi-osaka, all of Japan

[73] Assignee: Mita Industrial Co., Ltd., Osaka, Japan

[21] Appl. No.: 838,325

[22] Filed: Feb. 20, 1992

Related U.S. Application Data

[63] Continuation-in-part of Ser. No. 593,985, Oct. 9, 1990, abandoned.

[30] Foreign Application Priority Data

Oct. 9, 1989 [JP] Japan ..... 1-262243
Mar. 2, 1990 [JP] Japan ..... 2-49513

[51] Int. Cl.[5] ..... G03G 9/083

[52] U.S. Cl. ..... 430/106.6; 430/108

[58] Field of Search ..... 430/110, 106.6, 108

[56] References Cited

U.S. PATENT DOCUMENTS 5,021,317 6/1991 Matsubara et al. ..... 430/110
5,110,703 5/1992 Nagatsuka et al. ..... 430/106.6

*Primary Examiner*—John Goodrow
*Attorney, Agent, or Firm*—Sherman and Shalloway

[57] ABSTRACT

Disclosed is a two-component type developer comprising a toner and a coated magnetic carrier wherein said toner has an electroconductivity lower than $3.5\times10^{-10}$ S/cm and the coating of said magnetic carrier consists of a silicone resin having as its component unit a basic nitrogen atom-containing organic group bonded to a silicone atom (N-containing silicone resin).

Such developer is capable of forming images having a high image density and a high image quality, particularly as a white developer or a color developer if developing is carried out even under ordinary conditions, since the toner has its charge quantity maintained in an appropriate range in the developing step.

13 Claims, 4 Drawing Sheets

PRESENT INVENTION : ○ TwY-5 (CONTENT OF FINE PARTICLES HAVING SIZE SMALLER THAN 250 MESH IS LOWER THAN 8% BY WEIGHT)

CONVENTIONAL TECHNIQUE : △ F2 (CONTENT OF FINE PARTICLES HAVING SIZE SMALLER THAN 250 MESH IS 27% BY WEIGHT)

MAGNETIC CARRIER FOR ELECTRONIC REPRODUCTION COATED WITH A NITROGEN CONTAINING SILICONE RESIN

This application is a continuation-in-part application of the application Ser. No. 07/593,985 filed on Oct. 9, 1990, which has now been abandoned.

BACKGROUND OF THE INVENTION (1) Field of the Invention

The present invention relates to a two-component type magnetic developer comprising a toner and a resin-coated magnetic carrier.

(2) Description of the Related Art

In the field of commercial electronic reproduction, there is widely used the two-component type magnetic developer comprising a toner and a magnetic carrier for developing an electrostatic image formed on the surface of the photosensitive material.

An ordinary developing mechanism in which a developer as described above is used has a structure as shown in FIG. 1. More specifically, a box-shaped toner supply mechanism 4 is arranged on the developing mechanism 2 and a toner 6 is supplied from above. The toner 6 is fed into a developing device 10 disposed below through a supply opening 8 equipped with a feeder and is stirred together with a carrier in the developing device 10 by stirrers 12 to form a two-component type developer 14.

A developing sleeve (developer-supporting member) 16 equipped with many magnetic poles is arranged in the developing device 10. The developer 14 having the frictionally charged toner is supplied into the developing sleeve 16 and a magnetic brush 18 of the developer is formed on the surface of the sleeve by a magnetic force. The length of the magnetic brush 18 is adjusted by a brush-cutting mechanism 20, and a uniform layer of the developer is formed on the surface of the developing sleeve 16. This developer layer is delivered to the nip position to a surface photosensitive layer 24 of an electrophotographic photosensitive material drum (image carrier) 22. The photosensitive material drum 22 is arranged apart by a distance DD-S from the developing sleeve 16, and the developing sleeve 16 and photosensitive material 22 are rotatably supported and are driven so that the moving directions (indicated by arrows) of the sleeve 16 and drum 22 are the same at the nip position (the rotation directions are reverse to each other).

A corona charger 26 connected to a variable high voltage power source 25 and an optical system 28 for the light exposure are arranged around the photosensitive material drum 22 upstream of the developing device 10 to form an electrostatic latent image having a predetermined surface voltage. A bias power source 33 equipped with a voltage-adjusting mechanism 30 is connected between the photosensitive drum 22 and the developing sleeve 12 so that an optional value voltage (bias voltage) which has the same polarity as that of the surface voltage and is lower than the surface voltage is applied onto the photosensitive layer 24. A transfer mechanism 34 for transferring a toner image to a copying machine is arranged around the photosensitive layer 24 downstream of the developing zone.

In the above-mentioned structure, the developer 14 forms the magnetic brush 18 on the developing sleeve 16 and at the nip position, this magnetic brush 18 reacts with the electrostatic latent image of the photosensitive layer 24 to form a visible image of the toner on the photosensitive layer 24.

As a magnetic carrier in the two-component type developer, there is widely used a resin-coated magnetic carrier of which the surface is coated with an acrylic resin, etc. for preventing adhesion of the toner to the surface of the carrier, so-called "spent toner". In such resin-coated magnetic carrier, the deterioration of the carrier caused by the surface oxidation is effectively prevented. Accordingly the resin-coated magnetic carrier has an advantage that contamination of the toner (for example, discoloration of the toner) caused by oxides on the carrier surface can be prevented. As a consequence of the foregoing, such resin-coated magnetic carrier is effectively used in combination with a color toner, such as a white toner.

However, in case where a white toner, etc. compounded with a coloring agent having a low electroconductivity, such as titanium oxide, is used as the toner component of a two-component type magnetic developer, the charge quantity of the toner becomes very large compared with the charge quantity of the electrostatic latent image formed on the surface of the photosensitive layer upon development as a consequence of a high electric resistance of said toner. As a result, the obtained image density is low. That is to say, the decrease in the image density is caused by the presence of too few toner particles which have charge quantity sufficient to balance with the charge quantity of the electrostatic latent image.

Thus, as a means to avoid such decrease in the image density, it is conceivable to decrease the mount of resin coated on the magnetic carrier for the purpose of decreasing the electric resistance of the carrier. However, in case where acrylic resin is used as the coating resin, the amount of coating has to be decreased to a far extent in order to sufficiently decrease the electric resistance of the carrier. With such extreme decrease in the amount of coating, the resin film formed on the surface of the carrier becomes so thin as will render it impossible to effectively protect the surface of the carrier.

SUMMARY OF THE INVENTION

An object of the present invention, therefore, is to provide a two-component type developer comprising a resin-coated magnetic carrier and a toner, such as a white toner, having a low electroconductivity, said developer can be maintaining the charge quantity of the toner within an appropriate range without damaging protection of the carrier surface by said coating resin and can give a high-density image.

According to the present invention, there is provided a two-component type developer comprising a developer toner and a magnetic carrier coated with a resin, wherein the toner has an electroconductivity lower than $3.5\times10^{-10}$ S/cm and the coating resin of the magnetic carrier is a silicone resin containing a structure unit which has a basic nitrogen atom-containing organic group bonded to silicone atom (N-coating silicone resin).

In the present invention, by using the magnetic carrier coated with the N-containing silicone resin, the charge quantity of the toner can be maintained within an appropriate range, even when the toner, such as a white toner, has a low electroconductivity. For example, in case where an acrylic resin is used as the coating resin, as is clearly seen in FIG. 2, it is necessary to control the amount of coating up to 0.1% by weight, of the magnetic carrier, to keep the appropriate charge quantity of the toner. As a result, the toner contamination caused by oxides on the surface of the carrier cannot be prevented effectively as shown Comparative Example 1, and thus the obtained image is discolored.

It may appear very unlikely that an adequate charge quantity of the toner can be secured in the present invention by using N-containing silicon resin as a coating resin, different from an ordinary silicone resin which does not contain an organic group containing basic nitrogen atoms. It is inferred that N-containing silicone resin coated on the magnetic carrier would play type role of a charge inhibitor in the process of frictional charging caused by friction with the toner.

DETAILED DESCRIPTION OF THE INVENTION N-CONTAINING SILICONE RESIN

Figure 1:
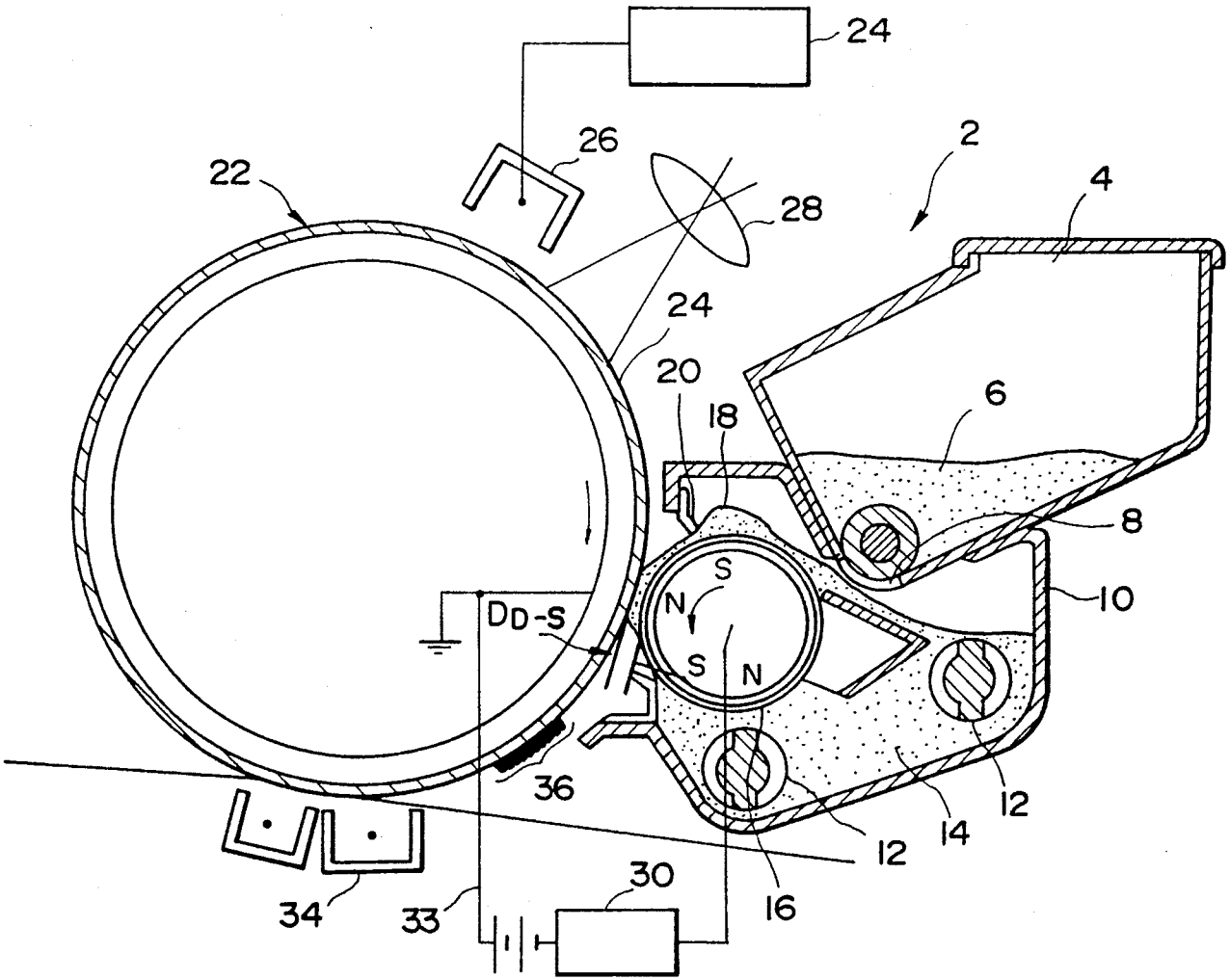
FIG. 1 is a diagram illustrating the developing mechanism.
Figure 2:
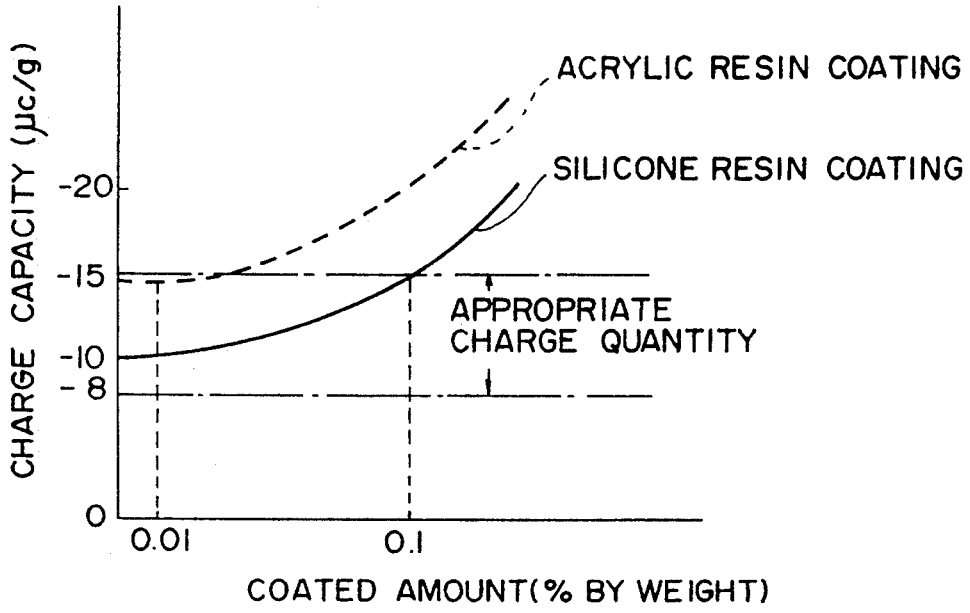
FIG. 2 is a graph illustrating the relation between the amount coated of the resin and the charge quantity of the carrier.
Figure 3:
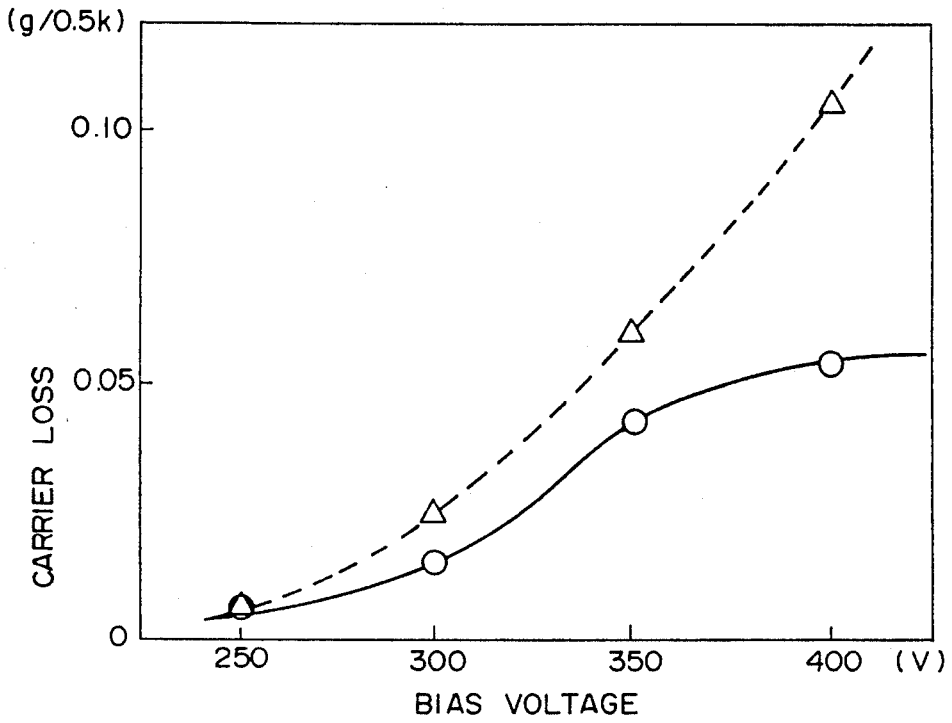
FIG. 3 is a graph illustrating the relation between the bias voltage and the occurrence of carrier dragging.

In the present invention, N-containing silicone resin to coat the magnetic carrier with comprises a basic nitrogen atom-containing organic group bonded to some silicon atoms in its molecules. This N-containing silicone resin is obtained by causing a silane compound or its oligomer to polycondensate by cohydrolysis with another silane compound or its oligomer, said former silane compound or its oligomer being represented, for example, by the following general formula (1):

$$R_{4-n}Si(R^1)_n \quad (1)$$

wherein R is a halogen atom, or a hydrolizable univalent group such as alkoxy, etc. having 4 or less carbon atoms. A plurality of R may be difference from one another, $R^1$ is a univalent basic nitrogen-containing organic group or a univalent hydrocarbon group containing a basic nitrogen atom, of which at least one group is a basic nitrogen-containing organic group and n is a integer of 1 to 3, and said latter silane compound being represented by the following general formula (2):

$$R_{4-n}Si(R^2)_n \quad (2)$$

wherein R and n are the same as aforementioned, and $R^2$ is a univalent hydrocarbon group containing no basic nitrogen atom.

Incidentally, in the present invention, a basic nitrogen atoms means any of the nitrogen atoms existing in basic nitrogen compounds such as amines, amides, imides and ammonium salts.

Examples of preferable univalent basic nitrogen-containing organic group of $R_1$ in the above-mentioned general formula (1) are aminoalkyl group such as aminomethyl, aminoethyl, and aminopropyl; aminoaryl group such as aminophenyl; N-substituted compounds of said groups; substituent groups furthermore containing a basic nitrogen atom of said N-substituted groups, while these examples by no means limit the extents of such groups.

Examples of univalent hydrocarbon groups which contain no basic nitrogen atom in $R^1$ in the above-mentioned general formula (1) and $R^2$ in the above-mentioned general formula (2) are alkyl groups such as methyl group, ethyl group, and propyl group; alkenyl group such as vinyl group and allyl group; aryl group such as phenyl group, tolyl group and ethylphenyl group; groups which have at least part of their hydrogen atoms substituted by halogen atoms, for example, chloromethyl group and 3,3,3-trifluoropropyl group.

Two or more kinds of the silane compounds or its oligomers represented by the general formulas (1) or (2) can be used as reactants. Polycondensation reaction is carried out under conventional conditions in the presence of an acidic or alkaline catalyst.

In the N-containing silicone resin used in the present invention, it is preferred that the content of the structure units derived from the monomer represented by the general formula (1) (i.e. basic nitrogen-containing units) be 0.1 to 5.0% by weight, particularly 0.2 to 3.0% by weight. If the basic nitrogen-containing unit content is less than the aforementioned range, it is difficult to fulfill the object of the present invention to decrease the electric resistance of the magnetic carrier, and if such content is more than the aforementioned range, the electric resistance of the magnetic carrier is lowered to such an excessive extent that the charged load of the toner leaks out.

Magnetic carrier

In the coated magnetic carrier used in the present invention, the amount of coating is selected at such a level whereat the magnetic carrier has an appropriate electric resistance in accordance with the photosensitive material and developing conditions adopted for development. In this case, the electric resistance of the magnetic carrier is computed on the basis of the value of electric current which flows through the carrier (hereinafter referred to as "carrier current value") when a certain voltage is applied. Accordingly, by selecting an appropriate carrier current in accordance with developing conditions, the amount of coating can be determined for the N-containing silicone resin to match such carrier current value.

Figure 4:
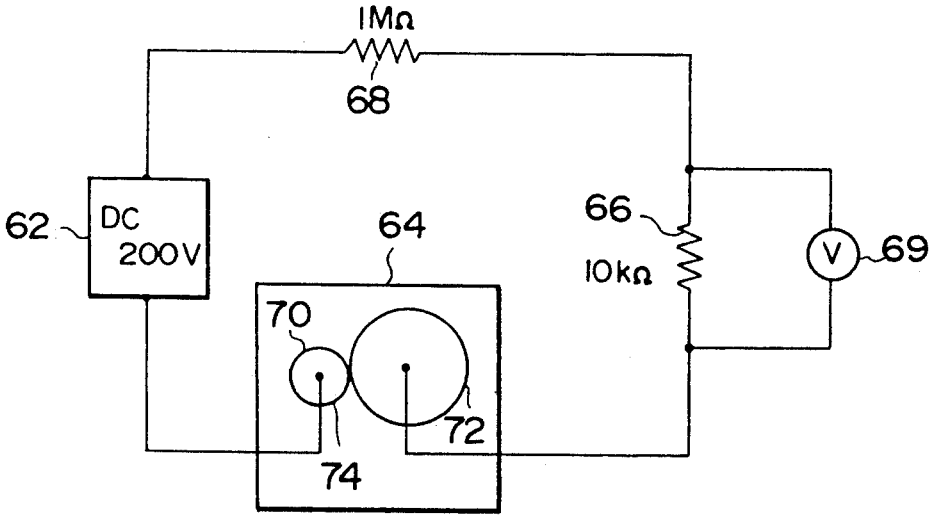
FIG. 4 is a diagram illustrating the apparatus for measuring the current value.

Such carrier current value is measured by a measuring apparatus illustrated by, for example, FIG. 4. This measuring apparatus is equipped with a developing box 64 comprising a magnet sleeve 70 and an aluminum tube 72 arranged apart by a distance of 4.5 mm from said magnet sleeve. A 10 KΩ resistor 66 and a 1 MΩ resistor 68 are connected in said order to the aluminum tube 72 in series. That is to say, the carrier current value is computed by this apparatus in such manner that a carrier layer 74 is formed by supplying the magnetic carrier onto magnet sleeve 70, a 200 V direct current is applied from the direct current power source 62 installed between magnet sleeve 70 and Resistor 68 under such condition and the potential difference between the two ends of the resistor 66 is measured.

In the measuring apparatus, changes in the electric resistance owing to variances in the quality of the aluminum tube 72, etc. are almost ignorable, since the electric resistance of the resistor 68 is so high as 1 MΩ. The carrier current value thus computed can be simulated into a carrier current value or an electric resistance of the carrier under actual developing conditions.

As the result of a number of experiments conducted by the inventors, using this measurement apparatus, it suffices under ordinary conditions to provide a coating on the surface of the carrier to such an extent that the aforementioned carrier current value falls within the range of 1 to 70 μA. Accordingly, the adequate range in which coating is provided to the surface of N-containing silicone resin is 0.01 to 0.5% by weight of the magnetic carrier core. Particularly, in cases where selenium photosensitive materials such as Se, Se-Te and Se-As are used as the photosensitive materials, the suitable range of the carrier current value is 0.5 to 3 mA (the amount of coated resin is 0.1 to 5.0% by weight), and, moreover, in case a positively chargeable type multilayer organic photosensitive material (OPC) consisting of a charge transporting layer, a charge generating layer and a protective coating layer if necessary is used as the electroconductive plate for the photosensitive material, the current value of the carrier is preferably in the range of 30 to 40 μA (the amount of coated resin is 0.01 to 0.5% by weight).

In case OPC is used as the photosensitive material, the adequate value of the carrier current value becomes markedly higher than in case a selenium photosensitive material is used for the following reason. That is to say, in such case, it is necessary to apply a bias voltage higher than 250 V between the developing sleeve holding the developer in the developing step and the photosensitive materials, since the residual potential difference of OPC is larger than in case of other photosensitive materials. (Incidentally, the bias voltage applied in the case of selenium photosensitive material is about 200 V). Consequently, the adequate charge quantity of the toner is considerably less than in case where selenium is used, and by the same token, the electric resistance required of the magnetic carrier is lower.

Since a high bias voltage is applied in development in case OPC is used s the photosensitive material, the carrier dragging phenomenon in which the magnetic carrier in the developer transfers onto the photosensitive material tends to take place, and the quality of the obtained image is apt to be degraded. The present invention effectively resolves the aforementioned problems thus demonstrating its conspicuous advantage.

The coating of the magnetic carrier, using the aforementioned N-containing silicone resin, can be carried out by a known method, for example, by atomizing an organic solvent solution of said resin and causing it to impinge against fluidized magnetic carrier particles, so-called the fluidized bed method, etc.

In the present invention, it is preferable that the coated magnetic carrier has its particle size adjusted to fall generally in the range of 70 to 120 μm in terms of the diameter $D_{50}$ of the weight average particle size corresponding to 50% of the weight of entire carrier particles in the magnetic carrier. Particularly, in case the carrier is used with a selenium photosensitive material, the adequate $D_{50}$ particle size range is 70 to 90 μm. In case the magnetic carrier is used with OPC, the adequate $D_{50}$ particle size range is 80 to 120 μm. The aforementioned particle size adjustment is suitable for effectively preventing undesirable blanking and carrier dragging, or the phenomenon of random spot-like transfer of the toner into the area other than the electrostatic latent imaged on the surface of the photosensitive material. Also suitable is said particle size adjustment for reducing the toner consumption to an adequate range. For example, if $D_{50}$ is lower than the aforementioned range, lowering of the electric resistance becomes conspicuous in carrier particles of small particle sizes, and blanking, carrier dragging and random spot-like transfer of the toner are apt to be caused.

If $D_{50}$ is higher than the aforementioned range, the consumption of the toner increases with the result that excessive image density is apt to occur, which phenomenon being by no means economically desirable.

Incidentally, the diameter $D_{50}$ of the weight average particle size of the magnetic carrier means such particle size whose integral value on the integral curve of its particle size distribution is 50%. In the present invention, it is desirable that the particle size is furthermore adjusted to such extents that the difference between the diameter $D_{25}$ and the diameter $D_{75}$ of the weight average particle size of the magnetic carrier is 20 μm or less and that the particle size of 250 mesh or less is 8% by weight or less, particularly by weight or less.

The magnetic carrier whose particle size is adjusted as such is suitable particularly for preventing carrier dragging, since it shows a sharp particle size distribution. Even in case the distance between the photosensitive material and the developing sleeve is narrowed to a very small extent, for example, 1 mm or less, carrier dragging can be effectively prevented.

In the present invention, such particle size adjustment may be performed at the time of magnetic carrier manufacturing or may be performed after the coating step.

In the present invention, as a magnetic carrier to be coated, sintered ferrite particles composed of at least one member selected from the group consisting of zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), lead iron oxide ($Pb_3Fe_{12}O_{19}$), nickel iron oxide ($NiFe_2O_4$), neodium iron oxide ($NdFeO_3$), copper iron oxide ($CuFe_2O_4$), barium iron oxide ($BaFe_{12}O_{19}$), magnesium iron oxide ($MgFe_2O_4$), and lanthanum iron oxide ($NdFeO_3$) is used. Particularly, in the present invention, soft ferrite containing at least one member selected from the group consisting of Cu, Zn, Mg, Mn, and Ni, preferably two members, for example, copper/-zinc/magnesium ferrite is used.

Toner

The toner used in combination with the aforementioned magnetic carrier in the present invention has an electroconductivity lower than $3.5\times10^{-10}$ S/cm, preferably $2.0\times10^{-10}$ to $3.0\times10^{-10}$ S/cm.

Such toners are white toner or color toners such as of the magenta type, cyan type, and yellow type.

For example, as the white pigment, there can be mentioned zinc flowers, titanium oxide, antimony white and zinc sulfide, and titanium oxide is especially preferably used. As the magenta type colorant, there can be mentioned C.I. Pigment 81, C.I. Pigment Red 122, C.I. Pigment Red 57, C.I. Solvent Red 49, C.I. Solvent Red 19, C.I. Solvent 52, C.I. Basic Red 10, and C.I. Disperse Red 15 (Disperse Red). As the cyan colorant, there can be mentioned C.I. Pigment Blue 15, C.I. Pigment Blue 16, C.I. Solvent Blue 25, C.I. Solvent Blue 55, C.I. Solvent Blue 70, C.I. Direct Blue 86, and C.I. Direct Blue 25. As the yellow type colorant, there can be mentioned C.I. Pigment Yellow 17, C.I. Pigment Yellow 12, C.I. Pigment Yellow 1, C.I. Pigment Yellow 97, C.I. Pigment 138, C.I. Pigment Yellow 12, C.I. Pigment Yellow 73, C.I. Pigment Yellow 13, C.I. Solvent Yellow 29, C.I. Solvent Yellow 162, and C.I. Solvent Yellow 93.

The aforementioned colorants are compounded generally at the ratio of 1 to 20% by weight of the weight of the binder resin. The toner thus compounded exhibits an electroconductivity within the aforementioned range.

As the binder resin, known binder resin can be used. Specific examples of such binder resin are styrene resin, acrylic resin, styrene/acrylic resin, polyester resin, polyurethane resin, silicone resin, polyamide resin, and modified rosin.

From the viewpoint of the binding property, particularly a binder resin having a glass transition point (Tg) of 50° to 65° C. is preferable. Furthermore, more preferable among said binder resins is styrene/acrylic resin. It is desirable that the binder resin comprises styrene monomer (A) and acrylic monomer (B) copolymerized in the weight ratio of A:B=50:50 to 90:10, particularly, 60:40 to 85:15. It is more preferable that the binder resin has an acid value of 25 or less.

In the aforementioned toner, known charge controlling agents, for example, Nigrosine Base (C.I. 50415), Oil Black (C.I. 26150), oil-soluble dye such as Spiron Black, metal-containing azo dye, metal salts of naphtenic acid, metal salts of alkylsalicylic acid, fatty acid soap, and resin acid salt may be optionally compounded to the extent that the color of the toner is not affected.

The particle size of the toner used in the present invention is preferably 8 to 14 μm as the median size based on the volume measured by a Coulter. The shape of the toner particles may be in an indeterminate shape or in a spherical shape. The indeterminate shape toner may be manufactured by so-called melt kneading and pulverization, or a spherical shape toner can be manufactured by suspension polymerization.

Developer

The developer of the present invention is prepared generally by mixing the aforementioned coated magnetic carrier and the toner at a weight ratio of 99:1 to 90:10, particularly, 98:2 to 95:5, and its loose apparent specific gravity is generally in the range of 1.7 to 2.1 g/cm$^3$, particularly, 1.8 to 2.0 g/cm$^3$.

In this case, it is possible to improve the flowability of the developer by means of shrinking a surface treating agent such as hydrophobic silica, etc. over the surface of said toner.

It is preferred that the initial charge quantity of the developer, as measured by the blow-off method be in the range of 5 to 25 μC/g (the absolute value), and the initial charge quantity is controlled within said range in accordance with the kind of the photosensitive material is used for developing in said range. For example, in case a selenium type photosensitive material is used, it is preferred that the initial charge quantity be adjusted in the range of 15 to 25 μC/g. In case OPC is used as the photosensitive material, it is preferred that the initial charge quantity be adjusted in the range ob 5 to 20 μC/g. Adjustment of such initial charge quantity can be made by mixing a coating magnetic carrier having said carrier current value with a toner at an appropriate ratio. In case other photosensitive materials than the selenium type and OPC type are used, it suffices to determine the kind and the amount compounded of the coated magnetic carrier so that the initial charge quantity will be appropriate for developing conditions.

Development using the developer of the present invention can be carried out using an electronic reproduction apparatus as illustrated by FIG. 1, under known conditions. As has been already described briefly, it is preferred that developing be carried out with a bias voltage of about 170 to 210 V applied across the developing sleeve 16 and the photosensitive material drum 22 in case the selenium type is used, and a bias voltage of 250 V or higher, particularly, 270 and 310 V, applied in case OPC is used. Incidentally, OPC disclosed in the Japanese Laid-Open Patent Application No. 118143/89 is preferably used.

According to the present invention, it is rendered possible to form an image of high density having an excellent image quality even when developing is carried out under ordinary conditions, since the charge quantity of the toner in the developing process is maintained in an appropriate range. The developer of the present invention is very useful particularly as a white developer or a color developer.

The present invention will now be described in detailed with reference to the following examples that by no means limit the scope of the invention.

EXAMPLES 1 THROUGH 4

Electronic reproduction was carried out, using a two-component developer prepared by mixing a toner with a magnetic carrier coated with N-containing silicone resin at a weight ration of 4.5/95.5. The evaluated values of obtained images are shown in Table 1.

The properties of the carriers and the toner used for this test and the test conditions are as follows.

Magnetic carrier

Using dimethyldichlorosilane, methyltrichlorisulane, and N-β-(aminoethyl)-γ-aminopropyltrimethoxysilane (hereinafter called "N-containing monomer")as a monomer, a N-containing silicone resin was obtained by polycondensating these monomers.

The N-containing monomer was used at the ratio of 2.0% by weight of the entire monomers.

The carrier current value and other properties of the magnetic carrier in the developer used in each Example are shown in Table 1.

Toner

The pigments used for the toners were as follows:

Phthalocyanine Blue B (C.I. Pigment Blue 15), Benzidine Yellow G (C.I. Pigment Yellow 12). The pigments were dispersed in styrene/acrylic resin along with toner additives to be formulated into a toner.

The kind of pigment, the electroconductivity and the average grain size of the toner used in the developer in each Example are shown in Table 1.

Properties of developer

The apparent density and the initial charge quantity of the developer prepared with the aforementioned magnetic carrier and the toner and used in each Example are shown in Table 1.

Developing conditions

Development was carried out, using OPC or the selenium-type photosensitive material as the photosensitive material, under conditions set forth in Table 1.

Comparative Examples 1 and 2

Electronic reproduction was carried out using developers obtained by mixing the magnetic carrier coated with acrylic polymer with the toner in the same manner as in the aforementioned Examples. Evaluated values of the obtained images and developing conditions are shown in Table 1.

TABLE 1

| Components | Physical Properties | Example 1 | Example 2 | Example 3 | Example 4 | Comparative Example 1 | Comparative Example 2 |
|---|---|---|---|---|---|---|---|
| magnetic carrier | coating resin | *1 | *1 | *1 | *1 | acrylic polymer | acrylic polymer |
| | amount coated (%) | 0.1 | 0.05 | 0.50 | 0.48 | 0.01 | 0.50 |
| | current value (μA) | 30.0 | 35.0 | 2.0 | 2.3 | 32 | 2.1 |
| | apparent density (g/cm$^3$) | 2.60 | 2.65 | 2.87 | 2.91 | 2.61 | 2.84 |
| | saturation magnetization (emu/g) | 65 | 65 | 65 | 63 | 65 | 65 |
| | flowability (sec/50 g) | 27 | 27 | 24 | 22 | 26 | 24 |
| | diameter $D_{50}$ of weight average particle size corresponding to 50% of weight of entire carrier particles (μm) | 99 | 99 | 82 | 78 | 83 | 65 |
| | content of particles having size smaller than 250 mesh (% by weight) | 3 | 2 | 8 | 7 | 10 | 12 |
| toner | colorant | titanium oxide | titanium oxide | C.I. Pigment Blue 16 | C.I. Pigment Yellow 12 | titanium oxide | C.I. Pigment Blue 16 |
| | electroconductivity (S/cm) | $2.9 \times 10^{-10}$ | $2.9 \times 10^{-10}$ | $2.5 \times 10^{-10}$ | $2.7 \times 10^{-10}$ | $2.9 \times 10^{-10}$ | $2.5 \times 10^{-10}$ |
| | particle size (μm) | 13 | 13 | 12 | 11 | 13 | 12 |
| developer | apparent density (g/cm$^3$) | 1.92 | 1.98 | 2.09 | 2.15 | 1.94 | 2.12 |
| | initial charge quantity (μg) absolute value | 18 | 15 | 17 | 18 | 15 | 30 |
| Developing Conditions | $D_{D-S}$ width (mm) | 0.8 | 0.8 | 1.1 | 1.2 | 0.8 | 1.2 |
| | brush cut length (mm) | 0.7 | 0.7 | 1.0 | 1.1 | 0.7 | 1.1 |
| | development voltage difference (V) | 460 | 460 | 590 | 600 | 460 | 600 |
| | bia voltage (V) | 290 | 290 | 230 | 240 | 290 | 240 |
| Results | carrier dragging (g/500 copies) | 0.1 | 0.09 | 0.07 | 0.08 | 0.35 | 0.41 |
| | blanking | — | — | not caused | not caused | — | caused |
| | image density | good | good | good | good | fair | fair |
| | image quality (by visual observation) | high whiteness | high whiteness | sharp | sharp | yellowing | sharp |
| Photosensitive Material | | *2OPC | *2OPC | Se type | Se type | *2OPC | Se type |

Note
*1: N-containing silicone resin
*2positively chargeable OPC

EXAMPLE 5

In the developer used in Example 1, the coating amount of the N-containing silicone resin was changed to examined the influence of the coating amount of the resin. The development conditions were the same as in Example 1. The obtained results are shown in Table 2.

TABLE 2

| | Run No. | | | | | | | |
|---|---|---|---|---|---|---|---|---|
| | 1 | 2 | 3 | 4 | 5 | 6 | 7 | 8 |
| The amount of resin coated on the carrier (%) | no coating | 0.005 | 0.01 | 0.05 | 0.1 | 0.5 | 0.7 | 1.0 |
| Carrier current value (μA) | 48.0 | 39.0 | 38.0 | 35.0 | 30.0 | 10.0 | 5.0 | 1.5 |
| | Properties of other carriers and toners used are the same as Example 1. | | | | | | | |
| The apparent density of the developer | 1.95 | 1.98 | 1.96 | 1.98 | 1.92 | 1.90 | 1.89 | 1.86 |
| The initial charge quantity of the developer | 20 | 14 | 16 | 15 | 18 | 19 | 18 | 19*1 |
| | Developing conditions are the same as in Example 1. | | | | | | | |
| Photosensitive material | Positively chargeable OPC | | | | | | | |
| Carrier dragging | 0.1 | 0.1 | 0.1 | 0.09 | 0.1 | 0.1 | 0.1 | 0.1 |
| blacking*2 | — | — | — | — | — | — | — | — |
| image density | low | good | good | good | good | good | low | low |
| image quality (whiteness) | low | low*3 | high | high | high | high | low*4 | low*4 |

Note
*1initial charge quantity tended to increase
*2blanking was not evaluated because white toner was used
*3uneven solid image area
*4insufficient image density

EXAMPLE 6

The development was carried out under various current values to examine the influence of the current value.

In case of the Se type photosensitive material, the current value of the carrier was changed in the developer of Example 3 and the develpment was carried out under the same conditions as in Example 3. Incidentally, the current value of the carrier was changed by adjusting the apparent density while keeping the amount coated of the coating resin constant. The obtained results are shown in Table 3.

In case of the positively chargeable OPC photosensitive material, the current value was changed in the developer of Example 2 and the development was carried out under the same developing conditions as in Example 2. Incidentally, the current value of the carrier was changed by adjusting the apparent density while keeping the amount coated of the resin constant. The obtained results are shown in Table 3.

TABLE 3

| Components | Physical Properties | Run No. 9 | 10 | 11 | 12 | 13 |
|---|---|---|---|---|---|---|
| magnetic carrier | amount coated of coating results (%) | | | 0.50 | | |
| | current value (μA) | 0.3 | 0.5 | 2.0 | 3.0 | 3.5 |
| | apparent density | 2.92 | 2.90 | 2.87 | 2.85 | 2.83 |
| | saturation magnetization | | | 65 | | |
| | flowability | | | 24 | | |
| | diameter $D_{50}$ | | | 82 | | |
| | content of particles having size smaller than 250 mesh | | | 8 | | |
| toner | colorant | C.I. Pigment Blue 16 | | | | |
| | electroconductivity | $2.5 \times 10^{-10}$ | | | | |
| | particle size | 12 | | | | |
| developer | apparent density | 2.10 | 2.05 | 2.09 | 2.11 | 2.09 |
| | initial charge quantity | 19 | 19 | 17 | 15 | 14 |
| Developing Conditions | DD-S width | 1.1 | | | | |
| | brush cut length | 1.0 | | | | |
| | development voltage difference | 590 | | | | |
| | bias voltage | 230 | | | | |
| Results | carrier dragging | 0.1 | 0.1 | 0.07 | 0.1 | 0.1 |
| | blanking | not caused | not caused | not caused | not caused | not caused |
| | image density | low | good | good | good | good |
| | image quality | low | sharp | sharp | sharp | low |
| Photosensitive Material | | Se type photosensitive material | | | | |

| Components | Physical Properties | Run No. 14 | 15 | 16 | 17 | 18 |
|---|---|---|---|---|---|---|
| magnetic carrier | amount coated of coating results (%) | | | 0.05 | | |
| | current value (μA) | 27 | 30 | 35 | 40 | 42 |
| | apparent density | 2.68 | 2.66 | 2.65 | 2.63 | 2.62 |
| | saturation magnetization | | | 65 | | |
| | flowability | | | 27 | | |
| | diameter $D_{50}$ | | | 99 | | |
| | content of particles having size smaller than 250 mesh | | | 2 | | |
| toner | colorant | titanium oxide | | | | |
| | electroconductivity | $2.9 \times 10^{-10}$ | | | | |
| | particle size | 13 | | | | |
| developer | apparent density | 1.91 | 1.92 | 1.98 | 1.99 | 1.97 |
| | initial charge quantity | 19 | 18 | 15 | 14 | 14 |
| Developing Conditions | DD-S width | 0.8 | | | | |
| | brush cut length | 0.7 | | | | |
| | development voltage difference | 460 | | | | |
| | bias voltage | 290 | | | | |
| Results | carrier dragging | 0.1 | 0.1 | 0.09 | 0.1 | 0.1 |
| | blanking | | — | — | | |
| | image density | low | good | good | good | good |
| | image quality | low | high | high | high | low |
| Photosensitive Material | | positively chargeable OPC | | | | |

EXAMPLE 7

Influences of the bias voltage were examined.

By using the developer of Example 1, the development was carried out under the same conditions as in Example 1 except that the bias voltage was changed as shown in Table 4. The obtained results are shown in Table 4. If the bias voltage was lower than 250 V, fogging was caused.

TABLE 4

| Components | Physical Properties | Run No. 19 | 20 | 21 |
|---|---|---|---|---|
| magnetic carrier | amount coated of coating resin | 0.1 | | |
| | current value | 30 | | |
| | apparent density | 2.68 | | |
| | saturation magnetization | 65 | | |
| | flowability | 27 | | |
| | diameter $D_{50}$ | 99 | | |
| | content of particles having size smaller than 250 mesh | 3 | | |
| toner | colorant | titanium oxide | | |
| | electroconductivity | $2.9 \times 10^{-10}$ | | |
| | particle size | 13 | | |
| developer | apparent density | 1.92 | | |

TABLE 4-continued

| Components | Physical Properties | Run No. 19 | 20 | 21 |
|---|---|---|---|---|
| | initial charge quantity | | 18 | |
| Developing Conditions | DD-S width | | | 0.8 |
| | brush cut length | | | 0.7 |
| | development voltage difference | 510 | 495 | 460 |
| | bias voltage | 240 | 255 | 290 |
| Results | carrier dragging | 0.05 | 0.05 | 0.1 |
| | blanking | — | — | — |
| | image density | good | good | good |
| | image quality | *1low | high | high |
| Photosensitive Material | | ( positively chargeable OPC ) | | |

Note
*1fogging was caused

EXAMPLE 8

Electronic reproduction was carried out in the same manner as in Example 1, except that the N-containing silicone resin was used in this Example such that it was obtained by differentiating the quantity of N-containing monomer as against the quantity of the entire monomer and the amount of resin coated was changed to 0.02% by weight of the carrier.

The results of evaluation of the obtained images are shown in Table 5.

The N-content in the coating resin is indicated in Table 5 by the amount of N-containing monomer (wt. %) as against the entire monomer used.

We claim:

TABLE 5

| | Run No. 22 | Run No. 23 | Run No. 24 | Run No. 25 |
|---|---|---|---|---|
| N-content of coating resin (%) | 0.05 | 0.25 | 2.0 | 6.0 |
| Magnetic carrier | | | | |
| Amount coated of coating resin (%) | 0.02 | 0.02 | 0.02 | 0.02 |
| Current value (uA) | 0.05 | 31 | 36 | 80 |
| Apparent density | 2.61 | 2.62 | 2.60 | 2.59 |
| Saturation magnetization | 65 | 65 | 65 | 65 |
| Flowability | 28 | 28 | 26 | 26 |
| Diameter $D_{50}$ | 96 | 95 | 96 | 97 |
| Content of particles having size smaller than 250 mesh | 4 | 6 | 3 | 2 |
| Toner | The same as in Example 1. | | | |
| Developer | 29.2 | 14.1 | 11.7 | 4.6 |
| Developing conditions | The same as in Example 1. | | | |
| Results | | | | |
| Carrier dragging | 0.14 | 0.06 | 0.07 | 0.25 |
| Blanking | caused | not caused | not caused | not caused |
| Image density | fair | good | good | low |
| Image quality (whiteness) | low | high | high | uneven density, image missing at the rear end |
| Photosensitive material | positively chargeable OPC | | | |

1. A two-component type developer comprising a developer toner and a magnetic carrier coated with a resin, wherein the toner has an electroconductivity lower than $3.5\times10^{-10}$ S/cm and the coating resin of the magnetic carrier is a N-containing silicone resin comprising a structure unit which has a basic nitrogen atom-containing organic group bonded to a silicone atom, wherein the silicone resin coating comprises 0.5% by weight or less based on the weight of the magnetic carrier.

2. A developer as set forth in claim 1, wherein the N-containing silicone resin coating has the structure unit derived from a basic nitrogen atom-containing monomer component in am amount of 0.1 to 5.0% by weight of the resin coating.

3. A developer as set forth in claim 1, wherein the coated magnetic carrier as a carrier current value of 0.1 to 70 μA, as measured by a measuring apparatus comprising a magnet sleeve, an aluminum drum installed apart by a distance of 4.5 mm from said sleeve, and 10 KΩ and 1 MΩ resistors connected to said aluminum drum in series, on conditions that said magnetic carrier is supplied into the space between said sleeve and drum, and a 200 V direct current voltage is applied across said magnet sleeve and resistors.

4. A developer for a selenium type photosensitive material as set forth in claim 3, wherein the coated magnetic carrier has the carrier current value of 0.5 to 3 μA.

5. A developer for an OPC photosensitive material as set forth in claim 3, wherein the coated magnetic carrier has the carrier current value of 30 to 40 μA.

6. A developer as set forth in claim 1, wherein said toner is a white toner.

7. A two component type developer comprising a developer toner and a magnetic carrier coated wit a silicone resin, wherein the toner has an electroconductivity of $2.0\times10^{-10}$ to $3.0\times10^{-10}$ S/cm and the magnetic carrier resin coating comprises a N-containing silane compound of the formula $$R_{4-n}Si(R^1)_n \quad (1)$$

wherein R is selected from the group consisting of halogen and alkoxy having 1 to 4 carbon atoms, $R^1$ is a basic nitrogen containing hydrocarbon group and n equals 1–3, and a silane compound of the formula $$R_{4-n}Si(R^2)_n \quad (2)$$

wherein R is selected from the group consisting of halogen and alkoxy having 1 to 4 carbon atoms, $R^2$ is a hydrocarbon group containing no basic nitrogen and n equals 1–3, and the said magnetic carrier resin coating comprising 0.01 to 0.50% by weight of said magnetic carrier, and said N-containing silane compound of formula (1) comprises 0.1 to 5.0% by weight of the magnetic carrier silicone resin coating.

8. A developer as set forth in claim 7 wherein the weight ratio of the magnetic carrier to toner is 99:1 to 90:10.

9. A developer as set forth in claim 7 wherein the toner is a member selected from the group consisting of white, magenta, cyan and yellow pigment color toners.

10. A developer as set forth in claim 7 wherein said N-containing silane compound of formula (1) comprises 0.2 to 3.0% by weight of the magnetic carrier silicone resin coating.

11. A developer as set forth in claim 7 wherein said toner is a white color toner.

12. A developer as set forth in claim 7 for a selenium type photosensitive material, wherein the coated magnetic carrier has a carrier current value of 0.5 to 3.0 μA.

13. A developer as set forth in claim 7 for an OPC photosensitive material, wherein the coated magnetic carrier has a carrier current value of 30 to 40 μA.

* * * * *